US007848932B2

(12) United States Patent
Goto et al.

(10) Patent No.: US 7,848,932 B2
(45) Date of Patent: Dec. 7, 2010

(54) STEREO ENCODING APPARATUS, STEREO DECODING APPARATUS, AND THEIR METHODS

(75) Inventors: Michiyo Goto, Tokyo (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 739 days.

(21) Appl. No.: 11/719,413

(22) PCT Filed: Nov. 28, 2005

(86) PCT No.: PCT/JP2005/021800

§ 371 (c)(1),
(2), (4) Date: May 16, 2007

(87) PCT Pub. No.: WO2006/059567

PCT Pub. Date: Jun. 8, 2006

(65) Prior Publication Data

US 2009/0150162 A1 Jun. 11, 2009

(30) Foreign Application Priority Data

Nov. 30, 2004 (JP) ..... 2004-347273
Mar. 31, 2005 (JP) ..... 2005-100850

(51) Int. Cl.
*G10L 19/00* (2006.01)

(52) U.S. Cl. ..... 704/500

(58) Field of Classification Search ..... 704/500–504
See application file for complete search history.

(56) References Cited

U.S. PATENT DOCUMENTS 6,614,365 B2 9/2003 Suzuki et al.
7,519,538 B2 * 4/2009 Villemoes et al. ..... 704/501
2003/0091194 A1 5/2003 Teichmann et al.

(Continued)

FOREIGN PATENT DOCUMENTS

JP 2002-244698 8/2002

(Continued)

OTHER PUBLICATIONS

Herre J: "From Joint Stereo to Spatial Audio Coding—Recent Progress and Standardization", Proceedings of the International Conference on Digital Audioeffects, XX, XX, Oct. 5, 2004, pp. 157-162, XP002367849.

Faller C et al.: "Efficient representation of spatial audio using perceptual parametrization", Applications of Signal Processing to Audio and Acoustics, 2001 IEEE Workshop on the Oct. 21-24, 2001, Piscataway, NJ, USA, IEEE, Oct. 21, 2001, pp. 199-202, XP010566909.

(Continued)

*Primary Examiner*—Abul Azad
(74) *Attorney, Agent, or Firm*—Greenblum & Bernstein P.L.C.

(57) ABSTRACT

A stereo audio encoding apparatus capable of preventing degradation of the sound quality of a decoded signal, while reducing the encoding bit rate. A spatial information analyzer analyzes spatial information for each of a L channel signal and an R channel signal. A similarity raiser corrects, based on an analysis result of the spatial information analyzer, a difference between the spatial information of the L channel signal and that of the R channel signal, to raise a similarity between the L and R channel signals. A channel signal encoder uses a sound source common to the two channels to encode the L and R channel signals as raised in similarity and output the resultant single encoded information. A spatial information encoder encodes the analysis result of the spatial information analyzer to output the resultant encoded information.

15 Claims, 9 Drawing Sheets

U.S. PATENT DOCUMENTS

| | | | | |
|---|---|---|---|---|
| 2003/0191635 | A1 | 10/2003 | Minde et al. | |
| 2003/0236583 | A1 | 12/2003 | Baumgarte et al. | |
| 2005/0058304 | A1 * | 3/2005 | Baumgarte et al. | 381/98 |
| 2005/0078832 | A1 | 4/2005 | Van De Par et al. | |
| 2005/0254446 | A1 | 11/2005 | Breebaart | |
| 2006/0085200 | A1 * | 4/2006 | Allamanche et al. | 704/500 |

FOREIGN PATENT DOCUMENTS

| | | |
|---|---|---|
| JP | 2003-516555 | 5/2003 |
| WO | 02/23529 | 3/2002 |
| WO | 03/069954 | 8/2003 |
| WO | 03/090206 | 10/2003 |
| WO | 1376538 | 1/2004 |

OTHER PUBLICATIONS

Davidson et al., "Complexity Reduction Methods for Vector Excitation Coding," IEEE International Conference on ICASSP '86, vol. 11 , 1986, pp. 3055-3058.

Goto et al., "Onsei Tsushinyo Stereo Onsei Fugoka Hoho no Kento," 2004 Nen The Institute of Electronics, Information and Communication Engineers Engineering Sciences Society Conference Koen Ronbunshu, A-6-6, Sep. 8, 2004, p. 119.

Goto et al., "Channel-kan Joho o Mochiita Onsei Tsushinyo Stereo Onsei Fugoka Hoho no Kento," 2005 Nen The Institute of Electronics, Information and Communication Engineers Sogo Taikai Koen Ronbunshu, D-14-2, Mar. 7, 2005, p. 119.

Goto et al., "Onsei Tsushinyo Scalable Stereo Onsei Fugoka Hoho no Kento," FIT2005 (4th Forum on Information Technology) Koen Ronbunshu, G-017, Aug. 22, 2005, pp. 299-300.

Ramprashad, "Stereophonic CELP Coding Using Cross Channel Prediction," Proceedings of the 2000 IEEE Workshop, pp. 136-138, 2000.

U.S. Appl. No. 11/573,100 to Goto et al., filed Feb. 2, 2007.

U.S. Appl. No. 11/573,760 to Goto et al., filed Feb. 15, 2007.

* cited by examiner

STEREO ENCODING APPARATUS, STEREO DECODING APPARATUS, AND THEIR METHODS

TECHNICAL FIELD

The present invention relates to a stereo encoding apparatus that encodes a stereo signal, a stereo decoding apparatus corresponding to the stereo encoding apparatus, and a method thereof.

BACKGROUND ART

Like a call made using a mobile telephone, with speech communication in a mobile communication system, currently, communication using a monaural scheme (monaural communication) is mainstream. However, hereafter, like a fourth generation mobile communication system, if the transmission rate becomes a still higher bit rate, it is possible to ensure a bandwidth for transmitting a plurality of channels, so that it is expected that communication (stereo communication) using a stereo scheme will be also spread in speech communication.

For example, when it is considered that the current situation where the number of users increases who enjoy stereo music by recording music in a mobile audio player provided with a HDD (hard disc) and attaching earphones or headphones for stereo to the player, in the future, it is expected that mobile telephones and music players will be linked together and a life style will be prevalent where speech communication is carried out using a stereo scheme utilizing equipment such as earphones and headphones for stereo. Further, in an environment such as video conference that has recently become widespread, in order to enable conversations having high-fidelity, it is expected that stereo communication is performed.

On the other hand, in a mobile communication system and wired communication system, in order to reduce load of the system, it is typical to achieve a low bit rate of transmission information by encoding speech signals to be transmitted in advance.

As a result, recently, a technique for coding stereo speech signals attracts attention. For example, there is a coding technique for increasing the coding efficiency for encoding predictive residual signals to which weight of CELP coding for stereo speech signals is assigned, using cross-channel prediction (refer to non-patent document 1).

Non-patent document 1: S. A. Ramprashad, "Stereophonic CELP coding using cross channel prediction," In Proc. of the 2000 IEEE Workshop, pp. 136-138, 2000

DISCLOSURE OF INVENTION

Problems to be Solved by the Invention

However, the technique disclosed in non-patent document 1 has adaptive codebooks and fixed codebooks separately for speech signals of two channels, generates different excitation signals for each channel, and generates a synthesis signal. Namely, speech signals are CELP encoded for each channel, and obtained coding information of each channel is outputted to the decoding side. As a result, there is a problem that coding information is generated corresponding to the number of channels and that the amount of coding information (encoding bit rate) therefore increases.

It is therefore an object of the present invention to provide a stereo encoding apparatus, a stereo decoding apparatus, and a method thereof capable of preventing deterioration of speech quality of a decoded signal and capable of reducing the amount of coding information (encoding bit rate).

Means for Solving the Problem

A stereo encoding apparatus of the present invention has: a correction section that increases similarity between a first channel signal and a second channel signal by correcting both or one of the first channel signal and the second channel signal; a first encoding section that encodes the first channel signal and the second channel signal having increased similarity using a single excitation; and a second encoding section that encodes information relating to correction at the correction section.

Advantageous Effect of the Invention

According to the present invention, it is possible to prevent deterioration of the speech quality of a decoded signal and reduce the amount of coding information (encoding bit rate).

BEST MODE FOR CARRYING OUT THE INVENTION

Embodiments of the present invention will be described in detail with reference to the accompanying drawings. Here, the case will be described as an example where stereo signals made up of two channels are encoded.

Embodiment 1

Figure 1:
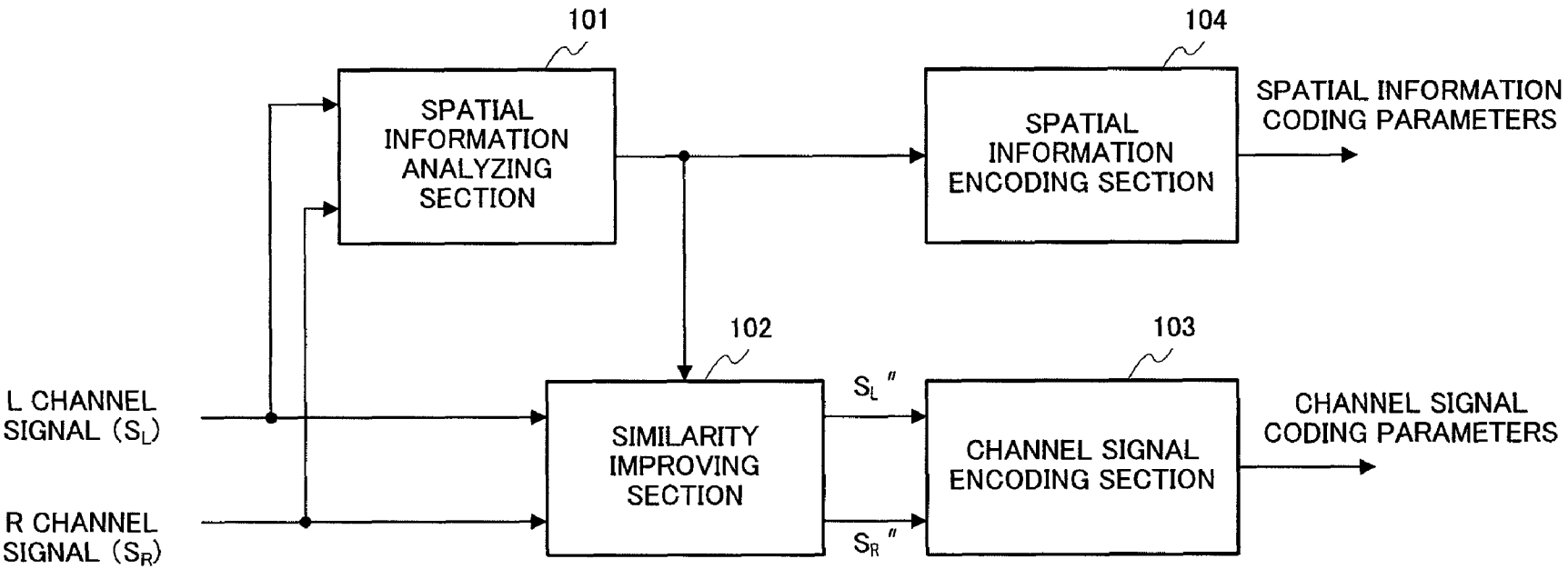
FIG. 1 is a functional block diagram of a stereo encoding apparatus according to Embodiment 1.

FIG. 1 illustrates the concept of a stereo encoding method according to Embodiment 1 of the present invention, that is, a functional block diagram of a stereo encoding apparatus according to this embodiment.

In the stereo encoding apparatus according to this embodiment, first, characteristic differences between an L channel signal and an R channel signal of a stereo signal that is an encoding target are corrected. As a result of this correction processing, the similarity between both channels is improved. In subsequent encoding processing, both channel signals after correction are encoded using a single excitation common to both channels, and a single coding parameter (a set of coding parameters when a single excitation is described with a plurality of coding parameters) is obtained. The signals of both channels are similar, and therefore it is also possible to carry out encoding using an excitation common to both channels.

Typically, even with sounds from the same source, signal waveforms exhibit different characteristics depending on the position where the microphone is positioned, that is, the pick-up position. As a simple example, energy of a stereo signal is attenuated according to a distance from the source, delays also occur in the arrival time, and different waveform spectra are exhibited depending on the pick-up positions. In this way, the stereo signal is substantially influenced by spatial factors such as the pick-up environment.

Figure 2:
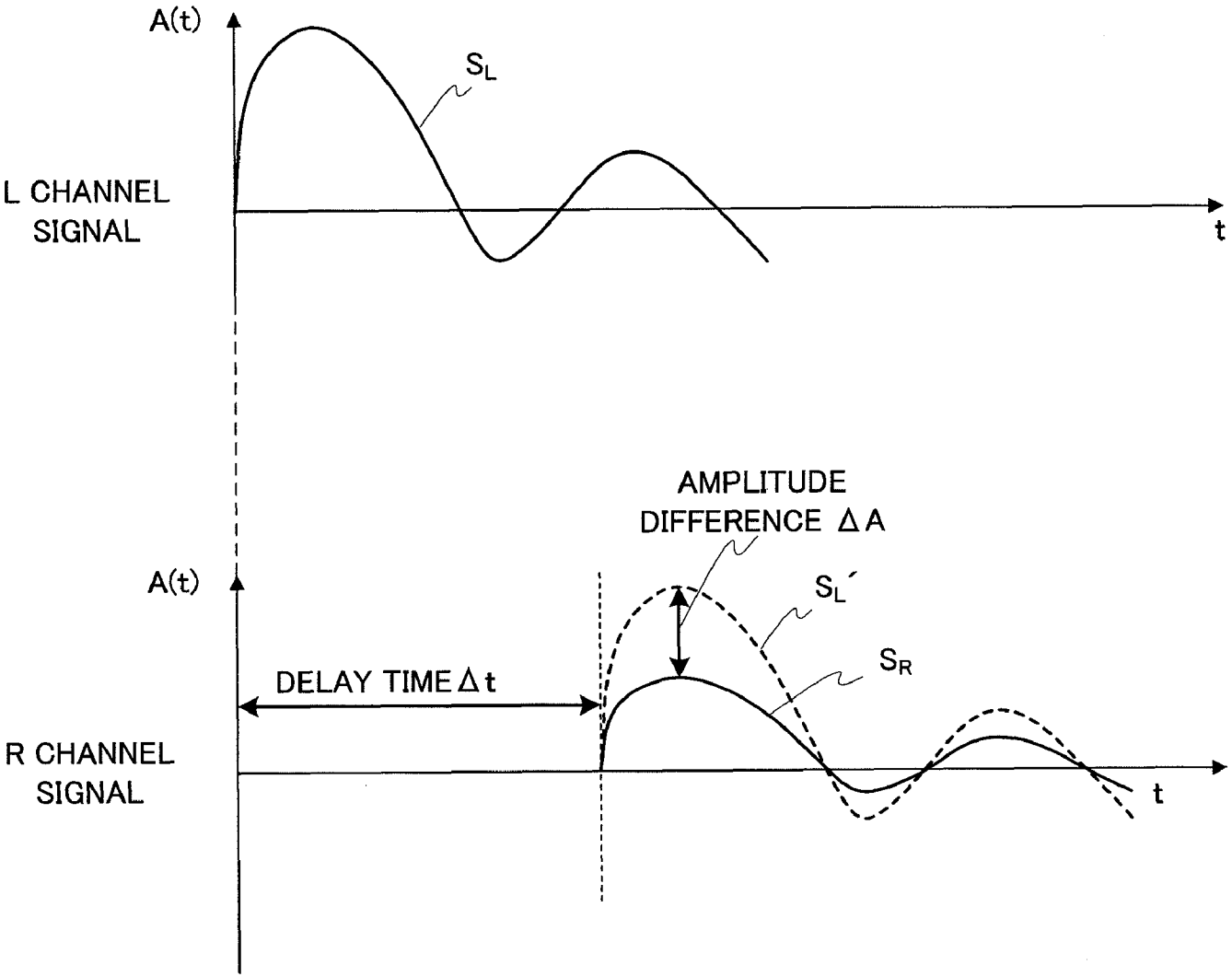
FIG. 2 shows an example of a waveform spectrum for a signal obtained by picking up the sound from the same excitation at different positions.

In order to explain in detail the characteristic of the stereo signal due to the differences in the pick-up environment, FIG. 2 shows an example of a waveform spectrum for signals (L channel signal $S_L$ and R channel signal $S_R$) obtained by picking up the sound from the same source at two different positions.

It can be seen from the drawings that the L channel and R channel signals exhibit different characteristics. It is possible to take the phenomenon of exhibiting these different characteristics as a result of adding new spatial characteristics different depending on the pick-up positions to the original signal waveform and picking up the sound by a pick-up equipment such as microphone. This characteristic is referred to as spatial information in this specification. For example, in the example in FIG. 2, when L channel signal $S_L$ is delayed by just time $\Delta t$, then this signal becomes L channel signal $S_L'$. Next, if the amplitude of L channel signal $S_L'$ is reduced by a fixed proportion and the amplitude difference $\Delta A$ is eliminated, L channel signal $S_L'$ is a signal from the same source, and therefore it can be expected that L channel signal $S_L'$ matches with R channel signal $S_R$, ideally. Namely, it can be considered that the characteristic difference between the L channel signal and the R channel signal can be corrected by removing the difference in spatial information of both channels.

In this embodiment, by applying appropriate correction in one or both of spatial information of the L channel signal and the R channel signal, the waveforms for the two channel signals become close, and the similarity of these signals is improved. As a result, it is possible to share the excitation used in encoding processing and obtain accurate coding information by generating a single (or a set of) coding parameter without generating respective coding parameters for signals of both channels as coding parameters.

When the spatial information is explained in detail, spatial information is information relating to space between the sound source and each sound pick-up equipment. For example, the amplitude and phase of each channel signal change depending on the position of the sound pick-up equipment. It can therefore be considered that each channel signal contains information relating to space from the sound source to each sound pick-up equipment. The stereo signal then gives the listener the feeling that the sound image is broad as a result of this spatial information. Further, it is possible to consider between the channels in the same way. For example, it can be considered that the L channel signal contains information relating to space between the sound pick-up equipments for the L channel and R channel. As a result, by operating spatial information contained in the channel signals, it is possible to make the channel signals similar to the excitation signal or make the channel signals similar to a virtual channel signal. The inventors focus on this point and derive the present invention.

If the similarity between both channels is improved, the excitation can be shared by the L channel signal and the R channel signal. The similarity of both channels can be improved not only by correcting the spatial information, but also by correcting characteristics other than the spatial information as correction of the L channel signal and the R channel signal.

Spatial information analyzing section 101, similarity improving section 102 and channel signal encoding section 103 implement the above processing by carrying out the following operation.

Spatial information analyzing section 101 analyzes spatial information for the L channel signal ($S_L$) and R channel signal ($S_R$) and outputs the analysis results to similarity improving section 102 and spatial information encoding section 104. Similarity improving section 102 improves the similarity of the L channel signal and the R channel signal by correcting differences in spatial information for the L channel signal and the R channel signal according to the analysis results outputted from spatial information analyzing section 101. Similarity improving section 102 outputs the similarity improved L channel signal ($S_L''$) and the R channel signal ($S_R''$) to channel signal encoding section 103. Channel signal encoding section 103 encodes $S_L''$ and $S_R''$ using the excitation common to both channels, and outputs the obtained set of coding information (channel signal coding parameters). Spatial information encoding section 104 encodes the analysis results of spatial information outputted from spatial information analyzing section 101 and outputs the obtained coding information (spatial information coding parameters).

In the above description, the case has been described as an example where the waveforms of both $S_L$ and $S_R$ are corrected, and, as a result, two signals ($S_L''$ and $S_R''$) where the similarity has been improved are outputted from similarity improving section 102, but it is also possible to correct the waveform of either one of $S_L$ and $S_R$ so as to approach the waveform of the other. In this case, when, for example, correction is applied to $S_L$, the output of similarity improving section 102 becomes $S_L''$ and $S_R$. Namely, this is substantially the same as a configuration where $S_R$ is inputted directly to channel signal encoding section 103 without passing through similarity improving section 102.

Further, the following is also given as a specific example of the above spatial information.

For example, it is also possible to use two parameters of energy ratio and delay time difference between two channels as spatial information. These are parameters that are easy to quantify. Further, it is possible to use propagation characteristics for each frequency band such as, for example, phase difference and amplitude ratio as variation.

Figure 3:
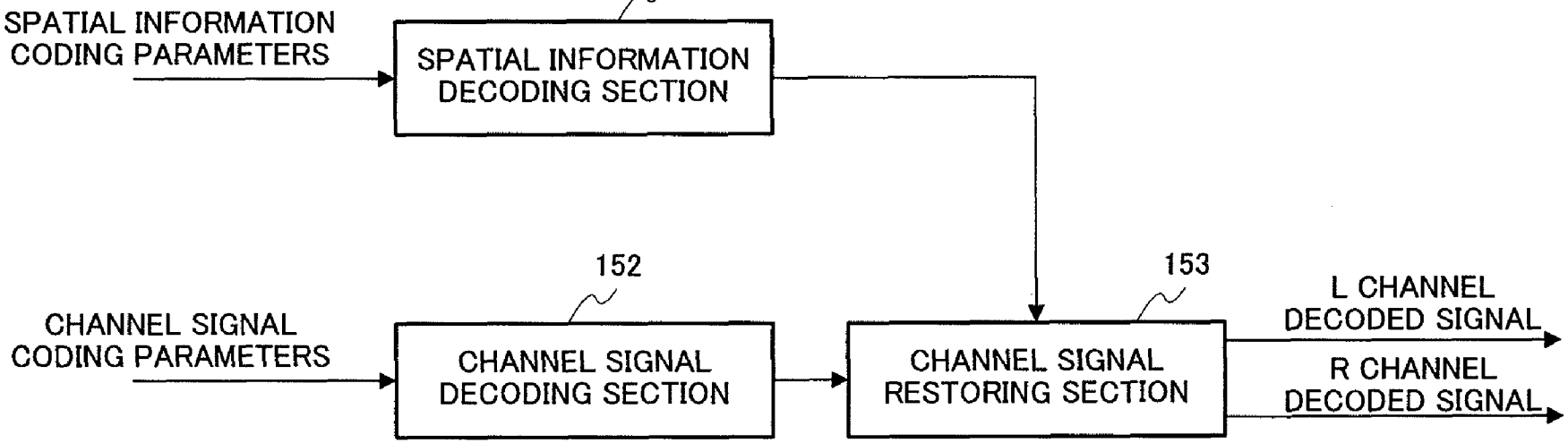
FIG. 3 is a functional block diagram of a stereo decoding apparatus according to Embodiment 1.

FIG. 3 is a functional block diagram of a stereo decoding apparatus according to this embodiment corresponding to the above-described stereo encoding apparatus.

Spatial information decoding section 151 decodes spatial information coding parameters, and outputs the obtained spatial information to channel signal restoring section 153. Channel signal decoding section 152 decodes the channel signal coding parameters and obtains a specific channel signal. This channel signal corrects spatial information of both channels of the L channel signal and the R channel signal so as to give a channel signal common to the L channel and R channel having increased similarity between both channels.

The signal common to the L channel and R channel is outputted to channel signal restoring section 153. Channel signal restoring section 153 restores an L channel signal and an R channel signal from the channel signal outputted from channel signal decoding section 152 using the spatial information outputted from spatial information decoding section 151 and outputs the results.

In this way, according to the stereo encoding method and stereo decoding method of this embodiment, the channel signals are encoded using the excitation common to the channels after increasing the similarity of the channel signals by correcting the channel signals of the stereo signal, so that it is possible to reduce the amount of coding information (coding bit rate). Further, the encoding side also encodes the difference of the spatial information between the channels and outputs the result, so that it is possible to accurately reconstruct each channel signal using this result on the decoding side.

In the above description, the case has been described as an example where encoding is performed for both channels using an excitation common to the channels after increasing the similarity of the channel signals. But the similarity of both channels is increased, so it is also possible to select just one channel as an encoding target and output coding information only for this selected channel. Also in this case, on the decoding side, the coding information of the selected channel is decoded, the selected channel signal can be reconstructed, and even for the unselected channel not selected on the encoding side, it is possible to reconstruct the unselected channel from the selected channel without substantial deterioration in quality using the spatial information outputted from the encoding side.

Further, there are various methods of correcting spatial information of both channel signals at similarity improving section 102. For example, there is a method of eliminating spatial information completely from both channel signals, restoring a source signal (speech signal generated at the sound source) from the L channel signal and R channel signal or regarding the arithmetic average [(L+R)/2] of the L channel signal and the R channel signal as a pseudo monaural signal, and removing predetermined spatial information from both channel signals, and thereby converting to a pseudo monaural signal. However, logically, even if it is possible to convert the L channel signal and R channel signal to a source signal and a pseudo monaural signal, sounds are only actually acquired at positions where the two microphones (L channel and R channel) are provided, and the encoding apparatus can only acquire the L channel signal and R channel signal.

Here, in the detailed embodiment of this embodiment, one of the L channel signal and R channel signal is taken as a main channel signal, the other is taken as a sub-channel signal, and predetermined spatial information is eliminated from the sub-channel signal, and thereby this signal is made similar to the main channel signal. The encoding apparatus acquires both an L channel signal and an R channel signal. Therefore, by comparing and analyzing the both channel signals, it is possible to obtain the above-described predetermined spatial information, that is, a difference between the spatial information of the L channel signal and the R channel signal.

Next, a stereo encoding method according to this embodiment will be described in detail using FIG. 4 and FIG. 5.

Figure 4:
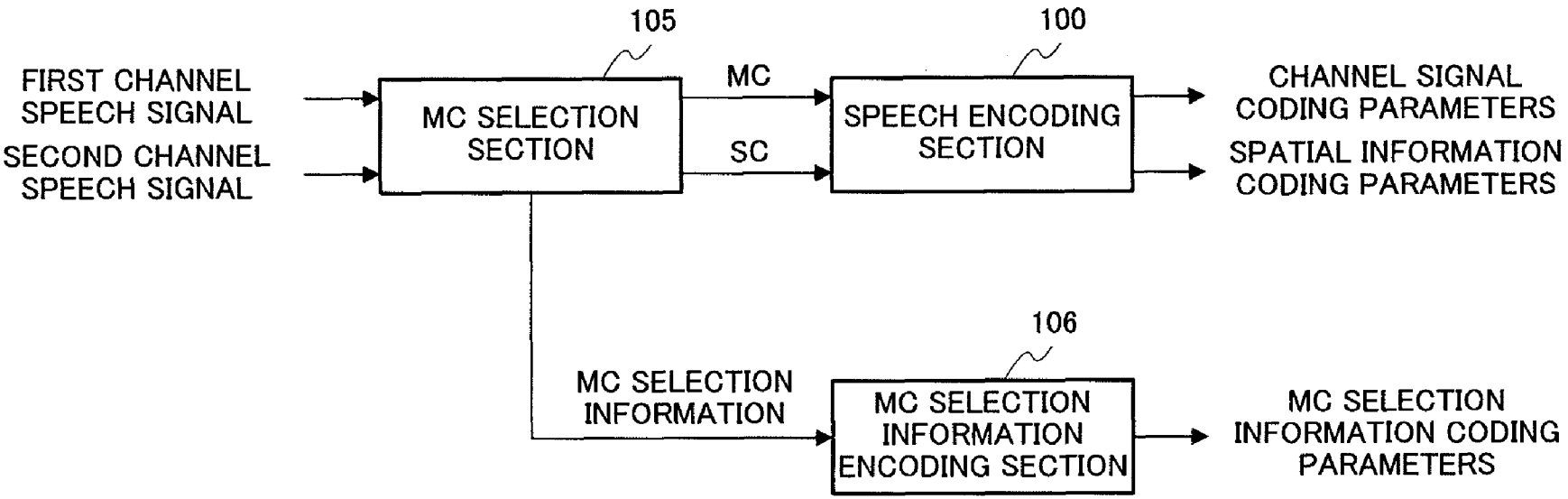
FIG. 4 is a block diagram showing the main configuration of a stereo speech encoding apparatus according to Embodiment 1.

FIG. 4 is a block diagram showing the stereo encoding apparatus according to this embodiment, that is, a main configuration of a stereo speech encoding apparatus realizing the concept of the stereo encoding method shown in FIG. 1. Here, the first channel speech signal and second channel speech signal described below indicate the L channel speech signal and R channel speech signal, respectively, or conversely, indicate the R channel speech signal and the L channel speech signal.

The stereo speech encoding apparatus according to this embodiment is provided with speech encoding section 100, MC selection section 105 and MC selection information encoding section 106. Speech encoding section 100 has a configuration corresponding to the whole function blocks shown in FIG. 1.

MC selection section 105 takes one of the inputted first channel speech signal and second channel speech signal as a main channel, and the other as a sub-channel, and outputs the main channel signal (MC) and sub-channel signal (SC) to speech encoding section 100.

Speech encoding section 100 first compares and analyzes the main channel signal and sub-channel signal, and obtains the difference of spatial information between both channels. Next, speech encoding section 100 removes the obtained difference of the spatial information from the sub-channel signal and makes the sub-channel signal similar to the main channel signal, encodes the main channel signal and the sub-channel signal made similar to the main channel signal, and outputs the obtained coding information (channel signal coding parameters). Further, speech encoding section 100 also encodes the difference of the obtained spatial information and outputs this coding information (spatial information coding parameters).

MC selection information encoding section 106 encodes MC selection information indicating which channel at MC selection section 105 is taken as the main channel, and outputs this coding information (MC selection coding parameters). The MC selection information coding parameters are transmitted to the decoding apparatus as coding information together with channel signal coding parameters and spatial information coding parameters generated at speech encoding section 100.

Figure 5:
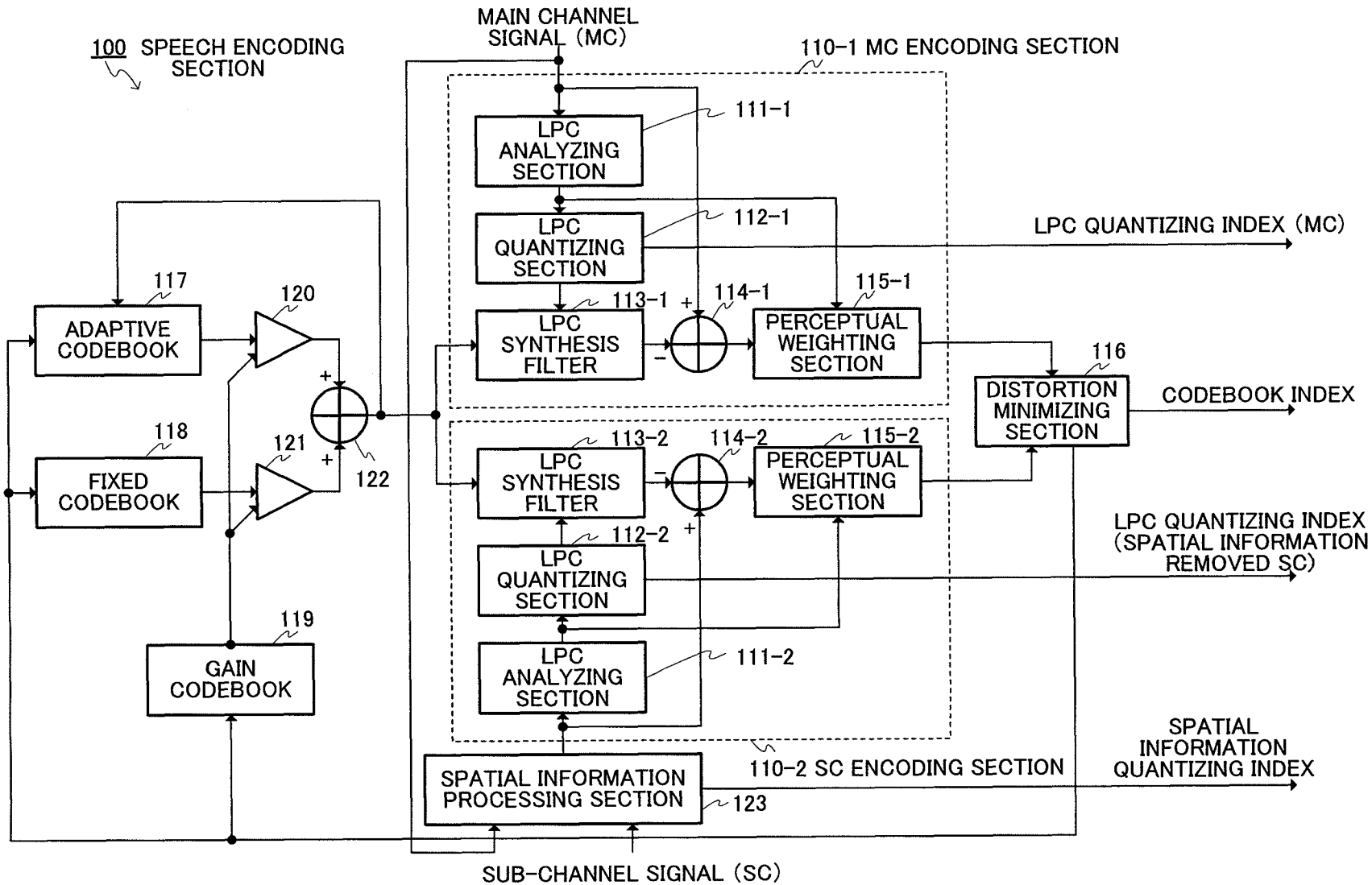
FIG. 5 is a block diagram showing the main configuration of an internal part of a speech encoding section according to Embodiment 1.

FIG. 5 is a block diagram showing the main configuration of the internal part of speech encoding section 100. Here, the case has been described as an example where CELP coding is used as a speech signal coding method.

Speech encoding section 100 mainly has MC encoding section 110-1 that encodes the main channel signal (MC), SC encoding section 110-2 that encodes the sub-channel signal (SC), spatial information processing section 123, and an adaptive codebook and fixed codebook common to both channels. Further, spatial information processing section 123 corresponds to spatial information analyzing section 101, similarity improving section 102 and spatial information encoding section 104 shown in FIG. 1.

MC encoding section 110-1 and SC encoding section 110-2 have the same internal basic configuration, although their encoding target signals are different. Therefore, the same components are assigned the same reference numerals with numerals land 2 added after hyphen in order to distinguish MC encoding section 110-1 from encoding section 110-2. Only the configuration of the MC encoding section 110-1 side will be described, and a description of the SC encoding section 110-2 side will be omitted.

Speech encoding section 100 encodes the main channel signal and sub-channel signal comprised of vocal tract information and excitation in formation by obtaining LPC parameters (linear predictive coefficients) for the vocal tract information, and, by obtaining an index which specifies which of the speech model stored in advance is used, that is, what kind of excitation vectors will be generated using adaptive codebook 117 and fixed codebook 118 for the excitation information, and thereby encodes the sound source information.

Specifically, each section of speech encoding section 100 performs the following operation.

LPC analyzing section 111-1 performs linear predictive analysis on the main channel signal, obtains an LCP parameter which is spectrum envelope information, and outputs the result to LPC quantizing section 112-1 and perceptual weighting section 115-1. LPC analyzing section 111-2 of SC encoding section 110-2 then carries out the above-described processing on the sub-channel signal subjected to predetermined processing by spatial information processing section 123. Processing of spatial information processing section 123 will be described later.

LPC quantizing section 112-1 quantizes LPC parameters obtained by LPC analyzing section 111-1, outputs the obtained quantized LPC parameters to LPC synthesis filter 113-1, and outputs a quantized LPC parameter index (LPC quantized index) as a coding parameter.

On the other hand, adaptive codebook 117 stores a past excitation used in common by both LPC synthesis filter 113-1 and LPC synthesis filter 113-2, and generates an excitation vector corresponding to one sub-frame from the stored excitation according to an adaptive codebook lag corresponding to the index indicated by distortion minimizing section 116. This excitation vector is outputted to multiplier 120 as an adaptive codebook vector.

Fixed codebook 118 stores a plurality of excitation vectors of a predetermined shape in advance, and outputs an excitation vector corresponding to the index indicated by distortion minimizing section 116 to multiplier 121 as a fixed codebook vector.

Adaptive codebook 117 is used in order to express components with strong periodicity, such as voiced speech, while on the other hand, fixed codebook 118 is used to express components with weak periodicity, such as white noise.

Gain codebook 119 generates a gain (adaptive codebook gain) for the adaptive codebook vector outputted from adaptive codebook 117 and a gain (fixed codebook gain) for the fixed codebook vector outputted from fixed codebook 118 according to an indication from distortion minimizing section 116, and outputs the gains to multipliers 120 and 121, respectively.

Multiplier 120 multiplies the adaptive codebook vector outputted from adaptive codebook 117 by the adaptive codebook gain outputted from gain codebook 119 and outputs the result to adder 122.

Multiplier 121 multiplies the fixed codebook gain outputted from gain codebook 118 by the fixed codebook vector outputted from fixed codebook 119 and outputs the result to adder 122.

Adder 122 then adds the adaptive codebook vector outputted from multiplier 120 and the fixed codebook vector outputted from multiplier 121, and outputs an excitation vector after addition to LPC synthesis filter 113-1 and LPC synthesis filter 113-2 as an excitation.

LPC synthesis filter 113-1 generates a synthesis signal using a filter function, that is, LPC synthesis filter, taking the quantized LPC parameters outputted from LPC quantizing section 112-1 as filter coefficients and taking the excitation vectors generated at adaptive codebook 117 and fixed codebook 118 as the excitation. This synthesis signal is then outputted to adder 114-1.

Adder 114-1 calculates an error signal by subtracting a synthesis signal generated at LPC synthesis filter 113-1 from the main channel signal (sub-channel signal after removing the spatial information at adder 114-2) and outputs this error signal to perceptual weighting section 115-1. This error signal corresponds to coding distortion.

Perceptual weighting section 115-1 performs perceptual weighting on the coding distortion outputted from adder 114-1 using an perceptual weighting filter taking the LPC parameters outputted from LPC analyzing section 111-1 as filter coefficients and outputs the result to distortion minimizing section 116.

Distortion minimizing section 116 takes into consideration both coding distortions outputted from perceptual weighting section 115-1 and perceptual weighting section 115-2, obtains indexes (codebook indexes) of adaptive codebook 117, fixed codebook 118 and gain codebook 119 for each sub-frame so that the sum of both coding distortions becomes a minimum, and outputs these indexes as coding information.

Specifically, coding distortion is expressed by the square of the difference between the original signal which is the encoding target and the synthesis signal. Therefore, when the coding distortion outputted from perceptual weighting section 115-1 is taken as $a^2$, and the coding distortion outputted from perceptual weighting section 115-2 is taken as $b^2$, distortion minimizing section 116 obtains indexes (codebook indexes) of adaptive codebook 117, fixed codebook 118 and gain codebook 119 where the sum of these coding distortions $a^2+b^2$ becomes a minimum.

The series of processing for generating a synthesis signal based on adaptive codebook 117 and fixed codebook 118 and obtaining the coding distortion of this signal constitute a closed loop (feedback loop). Distortion minimizing section 116 searches the codebooks by variously changing the index indicating to the codebooks within one sub-frame, and outputs the finally obtained indexes of the codebooks where coding distortion for both channels becomes a minimum.

Further, the excitation where the coding distortion becomes a minimum is fed back to adaptive codebook 117 for each sub-frame. Adaptive codebook 117 updates the stored excitation through this feedback.

Figure 6:
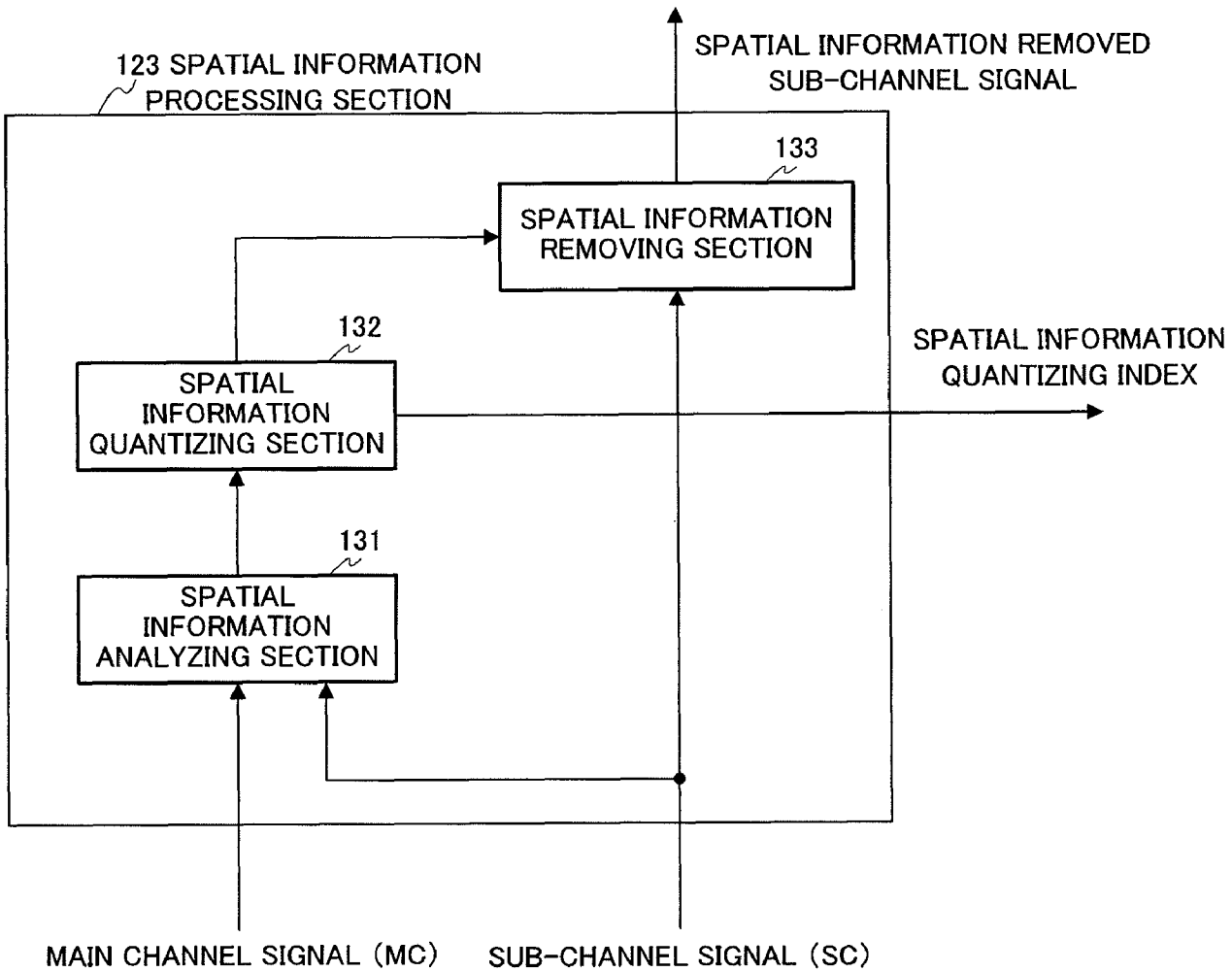
FIG. 6 is a block diagram showing the main configuration of an internal part of a spatial information processing section according to Embodiment 1.

FIG. 6 is a block diagram showing the main configuration of the internal part of spatial information processing section 123. Both the main channel signal and the sub-channel signal are inputted to this spatial information processing section 123.

Spatial information analyzing section 131 then obtains the difference of the spatial information for both channel signals by comparing and analyzing the main channel signal and the sub-channel signal, and outputs the obtained analysis result to spatial information quantizing section 132.

Spatial information quantizing section 132 quantizes the difference of the spatial information for both channels obtained by spatial information analyzing section 131 and outputs coding parameters (spatial information quantizing index) of the obtained spatial information. Further, spatial information quantizing section 132 then performs inverse quantization on the spatial information quantizing index which is obtained by quantizing the difference of the spatial information for both channels obtained at spatial information analyzing section 131 and outputs the result to spatial information removing section 133.

Spatial information removing section 133 converts the sub-channel signal into a signal similar to the main channel signal by subtracting the inverse-quantized spatial information quantized index outputted from spatial information quantizing section 132—the signal obtained by quantizing and inverse-quantizing the difference of the spatial information for both channels obtained by spatial information analyzing section 131—from the inputted sub-channel signal. The sub-channel signal in which this spatial information is removed is then outputted to LPC analyzing section 111-2.

Next, the processing of each section of spatial information processing section 123 will be described in detail using equations. First, the case will be described as an example where the energy ratio and delay time difference between two channels are used as spatial information.

Spatial information analyzing section 131 calculates an energy ratio between two channels in frame units. First, energies $E_{MC}$ and $E_{SC}$ within one frame of the main channel signal and sub-channel signal can be obtained according to the following equation 1 and equation 2.

(Equation 1)

$$E_{MC} = \sum_{n=0}^{FL-1} x_{MC}(n)^2 \quad [1]$$

(Equation 2)

$$E_{SC} = \sum_{n=0}^{FL-1} x_{SC}(n)^2 \quad [2]$$

Here, n is the sample number, and FL is the number of samples in one frame (frame length). Further, $x_{MC}(n)$ and $x_{SC}(n)$ indicate the amplitudes of the nth samples of the main channel signal and the sub-channel signal, respectively.

Spatial information analyzing section 131 then obtains square root C of the energy ratio of the main channel signal and sub-channel signal according to the next equation 3.

(Equation 3)

$$C = \sqrt{\frac{E_{MC}}{E_{SC}}} \quad [3]$$

Further, spatial information analyzing section 131 obtains a delay time difference that is an amount of time shift between two channel signals with respect to the main channel signal of the sub-channel signal as a value where cross correlation between two channel signals becomes the highest. Specifically, cross correlation function Φ for the main channel signal and the sub-channel signal can be obtained according to the following equation 4.

(Equation 4)

$$\phi(m) = \sum_{n=0}^{FL-1} x_{MC}(n) \cdot x_{SC}(n-m) \quad [4]$$

Here, it is assumed that m is a value in the range from min_m to max_m decided in advance, and m=M when Φ(m) is a maximum is a delay time with respect to the main channel signal of the sub-channel signal.

The above-described energy ratio and delay time difference may also be obtained using the following equation 5. In equation 5, energy ratio square root C and delay time difference m are obtained so that error D between the main channel signal and the sub-channel signal where the spatial information for the main channel signal is removed becomes a minimum.

(Equation 5)

$$D = \sum_{n=0}^{FL-1} \{x_{MC}(n) - C \cdot x_{SC}(n-m)\}^2 \quad [5]$$

Spatial information quantizing section 132 quantizes above-described C and m using a predetermined number of bits and takes the quantization values as $C_Q$ and $M_Q$, respectively.

Spatial information removing section 133 removes the spatial information from the sub-channel signal according to a conversion equation of the following equation 6.

(Equation 6)

$$x_{SC}'(n) = C_Q \cdot x_{SC}(n - M_Q) \quad [6]$$

(where n=0, . . . , FL−1)

As described above, according to this embodiment, the channel signals are encoded using an excitation common to channels after increasing the similarity of the channel signals by correcting the channel signals of the stereo signal, so that it is possible to reduce the amount of coding information (coding bit rate).

Further, the channel signals are encoded using a common excitation, and therefore it is no longer necessary to provide two sets of adaptive codebook, fixed codebook and gain codebook for the channels, and it is possible to generate an excitation using one set of codebooks. Namely, circuit scale can be reduced.

Further, in the above configuration, minimum distortion section 116 also takes into consideration the sub-channel signal in addition to the main channel signal, and carries out control so that the coding distortion for both channels becomes a minimum. As a result, coding performance becomes high, and it is possible to improve the speech quality of the decoded signal.

In FIG. 5 of this embodiment, the case has been described as an example where CELP coding is used for encoding the stereo speech signal, but, if the correction is performed for increasing the similarity between the L channel signal and the R channel signal and the two signals can be regarded as a pseudo single channel signal, it is also possible to reduce the amount of coding information, and therefore it is not necessary for the coding method to have excitation information decided in advance as a codebook like CELP coding.

Further, in this embodiment, the case has been described as an example where both two parameters of energy ratio and delay time difference between two channels are used as spatial information, but it is also possible to use either one of the parameters as spatial information. When only one parameter is used, the effect of increasing the similarity of the two channels decreases compared to the case where two channels are used, but conversely there is the effect that the number of coding bits can be further reduced.

For example, when only energy ratio between two channels is used as spatial information, the sub-channel signal is converted according to the following equation 7 using value $C_Q$ obtained by quantizing square root C of the energy ratio obtained using the above equation 3.

(Equation 7)

$$x_{SC}'(n) = C_Q \cdot x_{SC}(n) \quad [7]$$

(where n=0, . . . , FL−1)

For example, in the case of using only delay time difference between two channels as spatial information, the sub-channel signal is converted according to the following equation 8 using quantized value $M_Q$ obtained by quantizing m=M where Φ(m) obtained using the above equation 4 is maximum.

(Equation 8)

$$x_{SC}'(n)=x_{SC}(n-M_Q) \quad [8]$$

(where n=0, . . . , FL−1)

Embodiment 2

Figure 7:
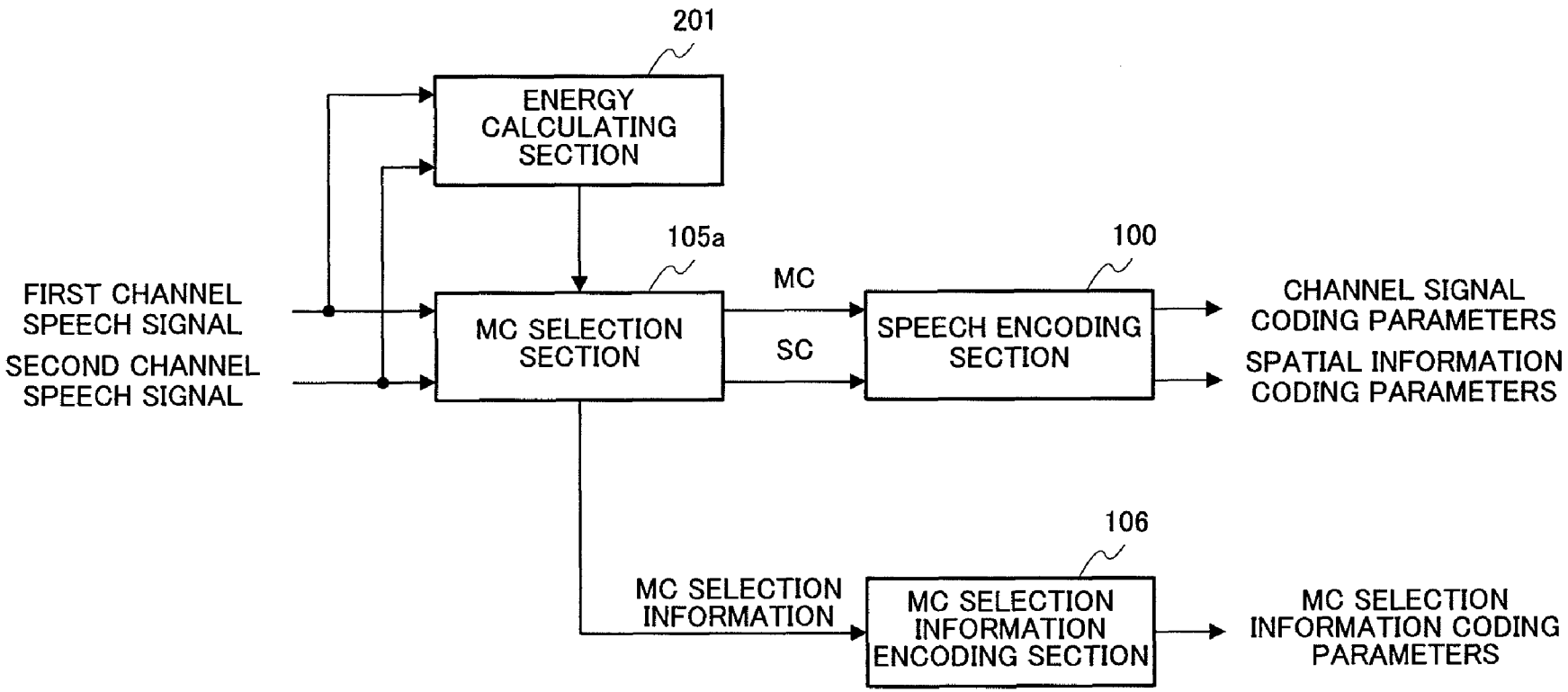
FIG. 7 is a block diagram showing the main configuration of a stereo speech encoding apparatus according to Embodiment 2.

FIG. 7 is a block diagram showing the main configuration of the internal part of a stereo speech encoding apparatus according to Embodiment 2 of the present invention. This stereo speech encoding apparatus has the same basic configuration as the stereo speech encoding apparatus (refer to FIG. 4) described in Embodiment 1, and therefore the same components are assigned the same reference numerals without further explanations.

Stereo speech encoding apparatus according to this embodiment calculates an energy of speech signals of both the first channel and the second channel and selects the channel with a larger energy as the main channel. Here, the energy is calculated for each frame, and the main channel is also selected for each frame. This will be described in detail in the following.

Energy calculating section 201 obtains energies $E_1$ and $E_2$ for each frame of the first channel speech signal and the second channel speech signal according to the following equations 9 and 10, and outputs the results to MC selection section 105*a*.

(Equation 9)

$$E_1 = \sum_{n=0}^{FL-1} x_1(n)^2 \quad [9]$$

(Equation 10)

$$E_2 = \sum_{n=0}^{FL-1} x_2(n)^2 \quad [10]$$

MC selection section 105*a* decides which of the signal of the first channel speech signal and the second channel speech signal is used as the main channel signal. Specifically, MC selection section 105*a* compares energies $E_1$ and $E_2$ of the two channels in frame units, takes the channel with the larger energy as the main channel and takes the channel with the smaller energy as the sub-channel. Namely, in the case of the conditions expressed by the following equation 11, the first channel is taken as the main channel, and the second channel is taken as the sub-channel.

(Equation 11)

$$E_1 \geqq E_2 \quad [11]$$

Further, in the case of the conditions expressed by the following equation 12, the second channel is taken as the main channel, and the first channel is taken as the sub-channel.

(Equation 12)

$$E_1 < E_2 \quad [12]$$

Selection between the main channel and the sub-channel is performed for each frame, and therefore MC selection information encoding section 106 encodes information (MC selection information) as to which channel is selected as the main channel.

In this way, according to this embodiment, energies of both channels are calculated for each frame, and the channel with the larger energy is selected as the main channel. Here, typically, it is assumed that the signal with the larger energy will contain a larger amount of information. As a result, in this embodiment, it is possible to make the coding error small by taking the channel with the larger amount of information as the main channel.

In this embodiment, the case has been described as an example where the energy of each channel is calculated and a main channel is selected based on this, but it is also possible to recognize the amount of information for each channel directly and select the channel with the larger amount of information as the main channel.

Further, in this embodiment, the case has been described as an example where the energy in frame units is simply taken as a main channel selection reference, but this is by no means limiting, and, for example, it is also possible to use a value where the energy is smoothed. As a result, it is possible to suppress excessive switching between the main channel and the sub-channel in accompaniment with fluctuation of the energy. Here, in order to smooth the energy, for example, smoothed energies $E_{1S}$ and $E_{2S}$ are obtained using the following equations 13 and 14.

(Equation 13)

$$E_{1S}=\alpha_{1S}E_{1S}+(1-\alpha_{1S})E_1$$

(Equation 14)

$$E_{2S}=\alpha_{2S}E_{2S}+(1-\alpha_{2S})E_2 \quad [14]$$

Here, α1S and α2S are constants satisfying the following equation 15.

(Equation 15)

$$0<\alpha_{1S},\alpha_{2S}<1 \quad [15]$$

Embodiment 3

In Embodiments 1 and 2 of the present invention, the actual encoding target of SC encoding section 110-2 is a sub-channel signal after the spatial information is removed by spatial information processing section 123. Specifically, SC encoding section 110-2 generates a synthesis signal from the sub-channel signal after the spatial information is removed, runs an optimized loop for the coding parameters so that coding distortion between this synthesis signal and the original spatial information removed sub-channel signal becomes a minimum. In other words, in Embodiments 1 and 2, in the sub-channel encoding, encoding is carried out taking the spatial information removed sub-channel signal as the encoding target and taking this spatial information removed sub-channel signal as a target signal for the encoding processing.

In Embodiment 3 of the present invention, in the sub-channel encoding, encoding is carried out taking the sub-channel signal before the spatial information is removed—the sub-channel signal still containing the spatial information—as a target signal for the encoding processing.

The basic configuration of the stereo speech encoding apparatus according to this embodiment is the same as the stereo speech encoding apparatus (refer to FIG. 4) shown in Embodiment 1, and is therefore not described, and speech encoding section 300 that has a different configuration from speech encoding section 100 (refer to FIG. 5) shown in Embodiment 1 will be described below.

Figure 8:
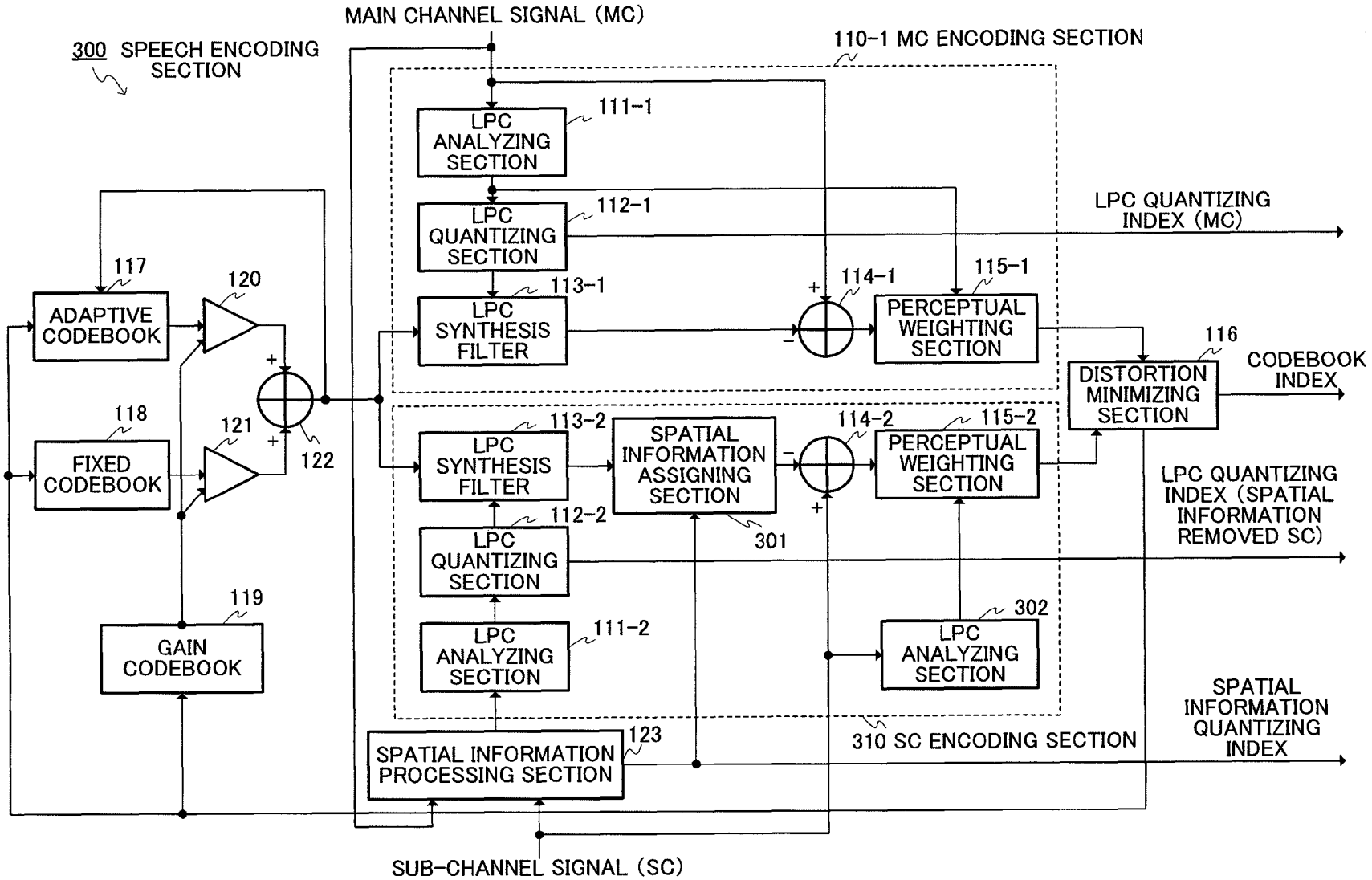
FIG. 8 is a block diagram showing the main configuration of an internal part of a speech encoding apparatus according to Embodiment 3.

FIG. 8 is a block diagram showing the main configuration of above-described speech encoding section 300. Components that are the same as speech encoding section 100 shown in Embodiment 1 will be assigned the same reference numerals without further explanations.

SC encoding section 310 adds the spatial information again using spatial information assigning section 301 to the sub-channel signal with the spatial information removed by spatial information processing section 123. Namely, spatial information assigning section 301 is provided with the spatial information for the sub-channel signal from spatial information processing section 123, adds this spatial information to the synthesis signal outputted from LPC synthesis filter 113-2, and outputs the result to adder 114-2.

Adder 114-2 calculates coding distortion by subtracting the spatial information assigned synthesis signal outputted from spatial information assigning section 301, from the sub-channel signal and outputs this coding distortion to distortion minimizing section 116 via perceptual weighting section 115-2.

Distortion minimizing section 116 obtains the index of the codebooks for each sub-frame so that the sum of both coding distortions becomes a minimum as described above for the coding distortions outputted from MC encoding section 110-1 and SC encoding section 310 and outputs the index as coding information.

Further, SC encoding section 310 is provided with LPC analyzing section 302 separately from LPC analyzing section 111-2 in order to assign perceptual weight to the sub-channel signal using the LPC coefficients generated based on the sub-channel signal.

LPC analyzing section 302 carries out LPC analysis taking the sub-channel signal as input and outputs the obtained LPC coefficients to perceptual weighting section 115-2.

Perceptual weighting section 115-2 assigns perceptual weight to the coding distortion outputted from adder 114-2 using the LPC coefficients outputted from LPC analyzing section 302.

Figure 9:
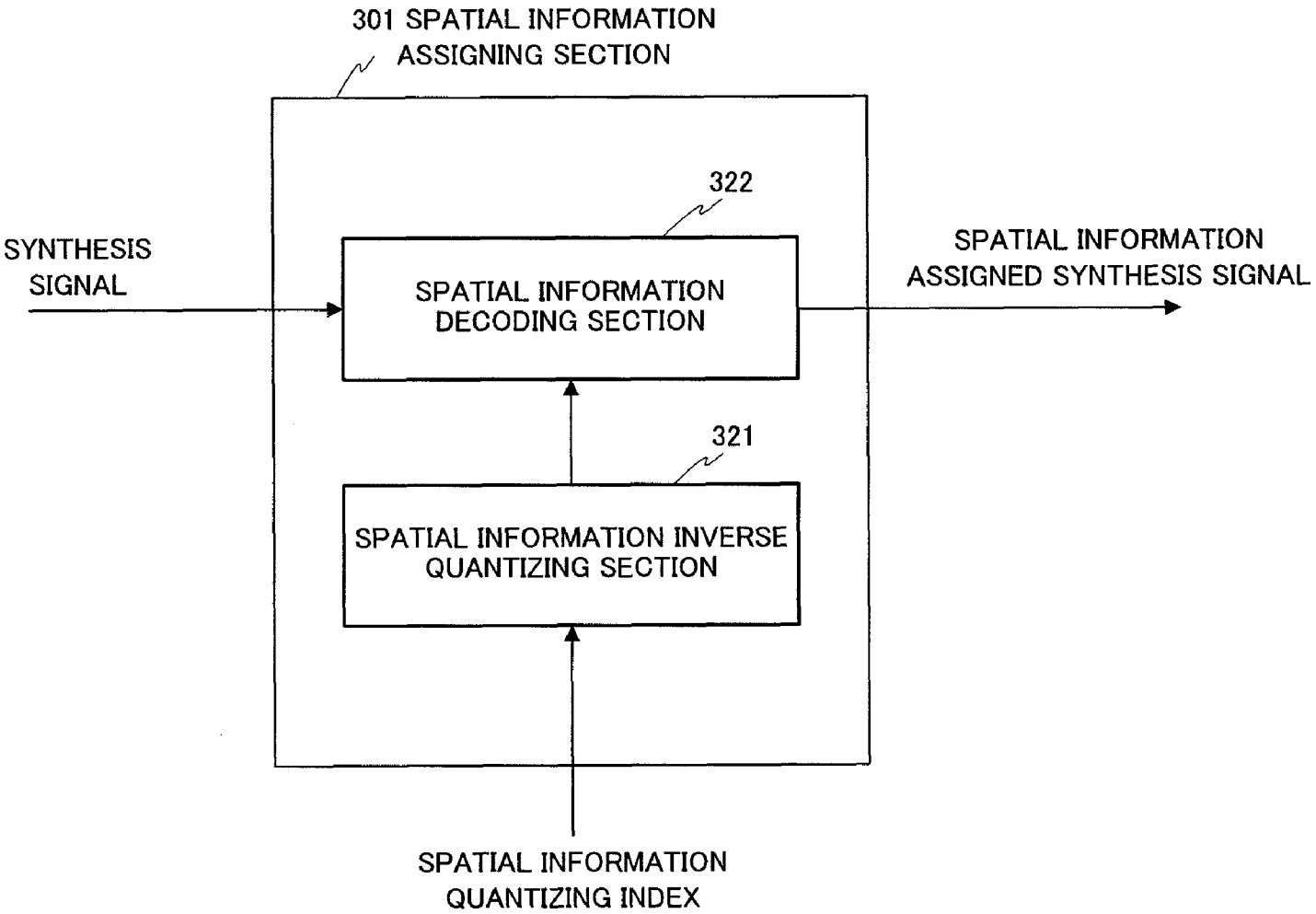
FIG. 9 is a block diagram showing the main configuration of an internal part of a spatial information assigning section according to Embodiment 3.

FIG. 9 is a block diagram showing the main configuration of the internal part of above-described spatial information assigning section 301.

Spatial information assigning section 321 performs inverse quantization on the spatial information quantized index outputted from spatial information processing section 123 and outputs the difference of the spatial information of the sub-channel signal with respect to the main channel signal to spatial information decoding section 322.

Spatial information decoding section 322 applies the difference of the spatial information outputted from spatial information inverse quantization section 321 to the synthesis signal outputted from LPC synthesis filter 113-2, generates a synthesis signal after the spatial information is assigned, and outputs the result to adder 114-2.

Next, processing for generating a sub-channel signal to which the spatial information at spatial information assigning section 301 is assigned will be described using an equation.

First, the case will be described where an energy ratio and delay time difference between the main channel signal and the sub-channel signal are used as spatial information. As in Embodiment 1, when the quantized values of the energy ratio and delay time difference which are spatial information quantization indexes are $C_Q$ and $M_Q$, respectively, spatial information inverse quantization section 321 obtains a difference of the spatial information of the sub-channel signal with respect to the main channel signal, that is, energy ratio C' and delay time difference M'. Spatial information decoding section 322 obtains the spatial information assigned sub-channel signal using the following equation 16.

(Equation 16)

$$x''_{SC}(n) = \frac{1}{C'} \cdot x_{SC}(n + M') \quad \text{(where } n = 0, \ldots, FL-1) \qquad [16]$$

Further, when only the energy ratio between the two channels is used as the spatial information, the spatial information assigned sub-channel signal is obtained using the following equation 17.

(Equation 17)

$$x''_{SC}(n) = \frac{1}{C'} \cdot x_{SC}(n) \quad \text{(where } n = 0, \ldots, FL-1) \qquad [17]$$

Moreover, when only the delay time difference between the two channels is used as the spatial information, the spatial information assigned sub-channel signal is obtained using the following equation 18.

(Equation 18)

$$x_{SC}''(n)=x_{SC}(n+M') \qquad [18]$$

(where n=0, . . . , FL−1)

In this way, according to this embodiment, in the sub-channel encoding, encoding is carried out taking the sub-channel signal before the spatial information is removed as the target signal for the encoding processing, so that it is possible to further improve encoding performance compared to Embodiments 1 and 2 for the following reasons.

Namely, in Embodiments 1 and 2, the spatial information removed sub-channel signal is taken as the encoding target, and the coding distortion is made to be a minimum. However, the signal to be finally outputted as the decoded signal is a sub-channel signal, and is not the sub-channel signal after the spatial information is removed. When the spatial information removed sub-channel signal is taken as a target signal for the encoding processing, coding distortion contained in the sub-channel signal which is the final decoded signal may not be sufficiently minimized. For example, even when the amplitude of the sub-channel signal is larger than the amplitude of the main channel signal, coding distortion of the sub-channel signal inputted to distortion minimizing section 116 can be calculated based on the signal after the energy difference with respect to the main channel signal is removed. However, at the decoding apparatus, a synthesis signal is generated by separately assigning decoded spatial information to the decoded sub-channel signal. The amplitude of the sub-channel signal is amplified as a result of the spatial information being assigned, and therefore the originally contained coding distortion is also amplified.

On the other hand, in this embodiment, the sub-channel signal itself where spatial information is not removed is taken as a target of encoding, and distortion minimizing processing is carried out on the coding distortion which may be contained upon obtaining the final decoded signal. As a result, it is possible to further improve coding performance.

Further, in the above configuration, the LPC coefficients used in the perceptual weighting processing are obtained by separately performing LPC analysis on the sub-channel signal which is an input signal of SC encoding section 310. Namely, perceptual weighting is carried out using perceptual weight reflecting the sub-channel signal itself which is to be the final decoded signal. It is therefore possible to obtain coding parameters with little perceptual distortion.

Embodiments of the present invention has been described above.

The stereo encoding apparatus and stereo encoding method according to the present invention are by no means limited to the above-described embodiments, and various modifications thereof are possible.

The stereo encoding apparatus of the present invention can be provided to a communication terminal apparatus and a base station apparatus in a mobile communication system so as to make it possible to provide a communication terminal apparatus and a base station apparatus having the same operation effects as described above. Further, the stereo encoding apparatus and stereo encoding method according to the present invention can be also used in a wired communication system.

Here, the case has been described as an example where the present invention is implemented with hardware, the present invention can be implemented with software. For example, it is possible to implement the same functions as the stereo encoding apparatus of the present invention by describing algorithms for processing of the stereo encoding method according to the present invention using programming language, and storing this program in a memory for implementation by an information processing section.

Further, the adaptive codebook may also be referred to as an adaptive excitation codebook, and the fixed code book may also be referred to as a fixed excitation codebook. Moreover, the fixed codebook may also be referred to as a stochastic codebook or a random codebook.

Furthermore, each function block used to explain the above-described embodiments is typically implemented as an LSI constituted by an integrated circuit. These may be individual chips or may partially or totally contained on a single chip.

Here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-347273, filed on Nov. 30, 2004, and Japanese Patent Application No. 2005-100850, filed on Mar. 31, 2005, the entire content of which is expressly incorporated by reference herein.

INDUSTRIAL APPLICABILITY

The stereo encoding apparatus, stereo decoding apparatus, and methods thereof according to the present invention can be applied to a communication terminal apparatus, a base station apparatus, and the like in a mobile communication system.

The invention claimed is:

1. A stereo encoding apparatus, comprising:

a corrector that increases a similarity between a first channel signal and a second channel signal by correcting at least one of the first channel signal and the second channel signal;

a first encoder that encodes the first channel signal and the second channel signal having the increased similarity using a single excitation; and a second encoder that encodes information relating to correction at the corrector, wherein the corrector takes one of the first channel signal and the second channel signal as a main channel signal, and takes an other channel signal as a sub-channel signal, obtains a difference between spatial information of the main channel signal and spatial information of the sub-channel signal, and removes the difference from the sub-channel signal, and the first encoder takes the sub-channel signal from which the difference is removed as a target signal for encoding processing.

2. The stereo encoding apparatus according to claim 1, wherein:

the corrector corrects spatial information contained in at least one of the first channel signal and the second channel signal; and the second encoder encodes information relating to correction of the spatial information.

3. The stereo encoding apparatus according to claim 2, wherein the spatial information contains at least one of an energy and a delay time of the first channel signal and the second channel signal.

4. The stereo encoding apparatus according to claim 1, wherein the first encoder comprises one of an adaptive codebook and a fixed codebook.

5. The stereo encoding apparatus according to claim 1, wherein the first encoder obtains the single excitation where a sum of coding distortions of both the first channel signal and the second channel signal becomes a minimum.

6. The stereo encoding apparatus according to claim 1, wherein the corrector carries out correction so that a waveform of the sub-channel signal approaches a waveform of the main channel signal.

7. The stereo encoding apparatus according to claim 6, wherein a channel signal having a large amount of information is a channel signal having a greater energy.

8. The stereo encoding apparatus according to claim 1, wherein:

the first encoder carries out encoding using a synthesis signal generated from the sub-channel signal from which the difference is removed.

9. A communication terminal apparatus comprising the stereo encoding apparatus according to claim 1.

10. A base station apparatus comprising the stereo encoding apparatus according to claim 1.

11. A stereo decoding apparatus, comprising:

a first decoder that decodes information relating to correction of at least one of a first channel signal and a second channel signal, in which a difference between spatial information of a main channel signal, represented by one of the first channel signal and the second channel signal, and spatial information of a sub-channel signal, represented by an other of the first channel signal and the second channel signal, has been obtained, in which the difference was removed from the sub-channel signal, the sub-channel signal from which the difference was removed having been a target signal for an encoding process;

a second decoder that decodes information relating to the first channel signal and the second channel signal which are corrected and have an increased similarity; and a restorer that restores the first channel signal and the second channel signal using the information relating to the correction and the information relating to the first channel signal and the second channel signal.

12. A communication terminal apparatus comprising the stereo decoding apparatus according to claim 11.

13. A base station apparatus comprising the stereo decoding apparatus according to claim 11.

14. A stereo encoding method, comprising:

increasing a similarity between a first channel signal and a second channel signal by correcting at least one of the first channel signal and the second channel signal;

encoding the first channel signal and the second channel signal having the increased similarity using a single excitation; and encoding information relating to correction at the correction section, wherein increasing a similarity takes one of the first channel signal and the second channel signal as a main channel signal, and takes an other channel signal as a sub-channel signal, obtains a difference between spatial information of the main channel signal and spatial information of the sub-channel signal, and removes the difference from the sub-channel signal, and wherein encoding the first signal channel and the second signal channel takes the sub-channel signal from which the difference is removed as a target signal for encoding processing.

15. A stereo decoding method, comprising:

decoding information relating to correction of at least one of a first channel signal and a second channel signal, in which a difference between spatial information of a main channel signal, represented by one of the first channel signal and the second channel signal, and spatial information of a sub-channel signal, represented by an other of the first channel signal and the second channel signal, has been obtained, in which the difference was removed from the sub-channel signal, the sub-channel signal from which the difference was removed having been a target signal for an encoding process;

decoding information relating to the first channel signal and the second channel signal which are corrected and have an increased similarity; and restoring the first channel signal and the second channel signal using the information relating to the correction and the information relating to the first channel signal and the second channel signal.

* * * * *